US005203953A

United States Patent [19]

Focke et al.

[11] Patent Number: 5,203,953

[45] Date of Patent: Apr. 20, 1993

[54] PROCESS AND APPARATUS FOR CONVEYING LABELS TO BE TRANSFERRED TO A (CIGARETTE) PACK

[75] Inventors: Heinz Focke, Verden; Hans-Jürgen Bretthauer, Bremen, both of Fed. Rep. of Germany

[73] Assignee: Focke & Co., Verden, Fed. Rep. of Germany

[21] Appl. No.: 660,827

[22] Filed: Feb. 26, 1991

[30] Foreign Application Priority Data

Feb. 26, 1990 [DE] Fed. Rep. of Germany ..... 4006021
Aug. 29, 1990 [DE] Fed. Rep. of Germany ..... 4027247

[51] Int. Cl.[5] ..... B65C 9/00

[52] U.S. Cl. ..... 156/566; 156/353; 156/354; 156/570; 156/571; 83/94; 83/165

[58] Field of Search ..... 156/353, 354, 566, 567, 156/568, 570, 571, 573, DIG. 28, DIG. 29, DIG. 30, DIG. 31; 83/93, 94, 165; 271/145, 165

[56] References Cited

U.S. PATENT DOCUMENTS

| | | | |
|---|---|---|---|
| 2,018,373 | 10/1935 | Maxwell | 156/DIG. 29 |
| 3,871,943 | 3/1975 | Zodrow | 156/568 X |
| 4,029,537 | 6/1977 | Kish | 156/568 X |
| 4,564,412 | 1/1986 | Oberdorf | 156/568 X |
| 4,589,943 | 5/1986 | Kimball et al. | 156/354 X |
| 4,589,949 | 5/1986 | Cavagnino | 156/571 X |
| 4,647,333 | 3/1987 | Voltmer et al. | 156/568 X |
| 4,680,023 | 6/1987 | Varano | 83/94 X |
| 4,840,696 | 6/1989 | Krasuski et al. | 156/353 |
| 5,009,740 | 4/1991 | Yanai | 156/353 X |

FOREIGN PATENT DOCUMENTS

| | | |
|---|---|---|
| 78076 | 5/1983 | European Pat. Off. . |
| 1249889 | 9/1967 | Fed. Rep. of Germany . |
| 1586399 | 4/1970 | Fed. Rep. of Germany . |
| 2236835 | 3/1973 | Fed. Rep. of Germany . |
| 2745866 | 4/1979 | Fed. Rep. of Germany . |
| 2913538 | 10/1980 | Fed. Rep. of Germany . |
| 3305608 | 12/1984 | Fed. Rep. of Germany . |
| 2550090 | 2/1987 | Fed. Rep. of Germany . |
| 3727034 | 6/1988 | Fed. Rep. of Germany . |
| 2111941 | 7/1983 | United Kingdom . |

*Primary Examiner*—David A. Simmons
*Assistant Examiner*—James J. Engel, Jr.
*Attorney, Agent, or Firm*—Sughrue, Mion, Zinn, Macpeak & Seas

[57] ABSTRACT

Labels (10), especially revenue stamps, are usually affixed to cuboidal cigarette packs (11). The labels have to be supplied and held ready for being received by the packs (11) in sufficient numbers. The labels (10) are successively severed length- or breadthways from a continuous web of material (17) and are then directly fed into a magazine (14), from which the labels are extracted at the lower end as required. Without any conversion, the type of labels to be processed can be changed by way of (temporarily) manually inserting labels into the magazine which is appropriately designed for this option.

10 Claims, 7 Drawing Sheets

PROCESS AND APPARATUS FOR CONVEYING LABELS TO BE TRANSFERRED TO A (CIGARETTE) PACK

BACKGROUND OF THE INVENTION

The invention relates to a process for conveying (thin) blanks, especially labels, to be transferred to a (cigarette) pack, the blanks (labels) being successively severed from a continuous web of material and being conveyed into a postion ready for being received by the pack. Furthermore, the invention relates to an apparatus for conveying the blanks or labels.

In many fields of the packaging art arises the need of supplying blanks, stamps or labels, ready for being affixed to packs. In the production of cigarette packs, revenue stamps or closure labels have to be attached to the packs. In high-performance packaging machines, these labels have to be available and have to be attached to the packs in great numbers per unit of time. For taking over the labels, the packs are usually moved past a transfer means (label drum) where they receive and take along one label each.

The blanks or labels may be provided to the packaging machine in stacks as finished units. In this case, the blank stacks are manually introduced into a chute-like magazine located at the machine-side and are extracted from said magazine from below by means of extraction means (so-called transfer rollers) for being transferred to the label drum.

It is, however, also already known in the art to sever the blanks or labels from a web of material of a respective width and to feed the labels to the packs by a specific unit.

SUMMARY OF THE INVENTION

The invention is based on the object to propose measures for an efficient and high-performance feed of the blanks or labels to the packs, with a changeover to other types of labels being easily possible within a small amount of time.

To attain this object, the invention sets out from the idea to alternatively either sever the labels or revenue stamps in the region of the packaging machine from a continuous web of material and to feed them to the packs or to introduce labels finished somewhere else into a magazine in stacks and to extract the blanks from this magazine for being fed to the packs.

According to one embodiment of the invention, the blanks, after having been severed from the web of material, are individually conveyed into the magazine in succession and deposited on a stack formed therein.

Alternatively, a web of material from which the labels are to be formed is fed to a cutting unit arranged immediately adjacent to the label conveyor, especially adjacent to the periphery of the label drum. The severed blanks are in this case directly received by a holding unit of the label conveyor and are fed to a pack. In this embodiment too, a magazine is arranged in the region of the label conveyor for an alternative feed of labels which have been prefabricated somewhere else.

When the labels are produced by being severed from a web of material in the region of the packaging machine, a great capacity of material can be made available, since the web of material is supplied in large reels. Nevertheless, a change in the type of production and feed of the blanks is possible without wasting much time or work. No resetting work is needed, since the magazine is directly available for being fed with labels produced elsewhere.

If, according to the one alternative of the invention, the labels are conveyed into a magazine after having been severed from the web of material, this is expediently done as a continuation of the conveying movement of the web of material, with the severed blanks entering the magazine laterally in the upper region of the magazine. The blanks can be accelerated after being severed from the web of material, so that they can be fed into the magazine at a higher speed.

According to a further proposal of the invention, the magazine is designed such that the blanks are turned by 90° while moving downward therein. As a result, the blanks have a different relative position when they are taken over by the label drum compared to when they were severed form the a web of material.

If the labels are received by the label holder of the label conveyor immediately after or during the severing process, a further proposal of the invention suggests to provide an extremely accurate drive of the web of material, specifically by means of feed rollers driven by a stepping motor and being controllable via markings on the web of material.

Further features of the invention relate to the design of the magazine and the severing and conveying means for the blanks.

Exemplary embodiments of the invention will be described below in more detail with reference to the drawings, in which:

DESCRIPTION OF PREFERRED EMBODIMENTS

Figure 1:
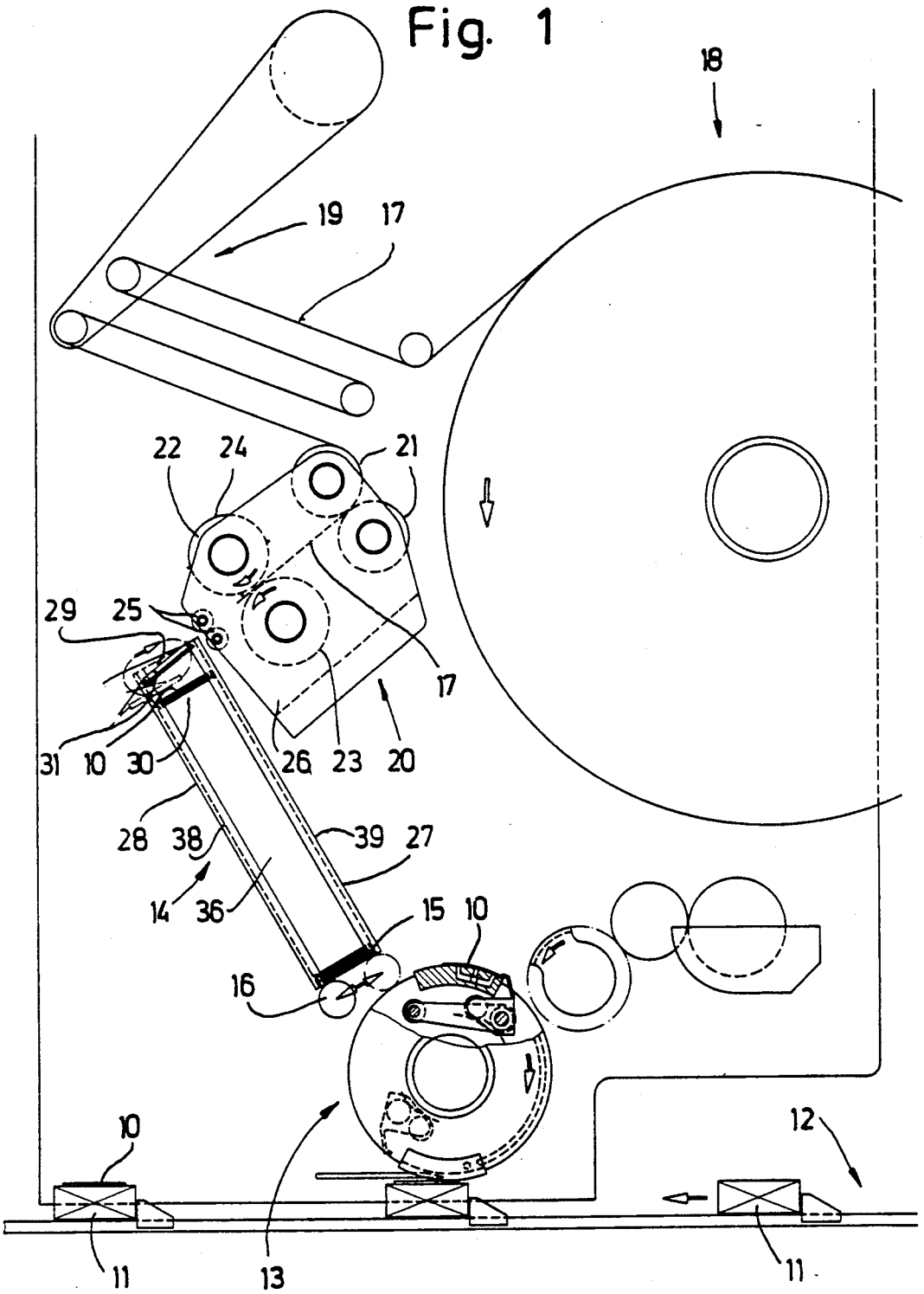
FIG. 1 is a schematic side view of an apparatus for producing and handling or conveying blanks (labels)

The embodiments shown in the drawings serve for feeding small rectangular blanks, namely labels 10, to a cuboidal (cigarette) pack 11. In the present embodiment, the labels 10 are to be placed on the top side of the pack 11. For this purpose, the packs 11 are transported at a distance from one another along a rectilinear pack path by means of a drag conveyor 12, with which the packs 11 are successively conveyed along the bottom side of a transfer means for the labels 10. In the present embodiment, the labels 10 are placed on the packs 11 by a rotating label drum 13. The labels 10 are held on the periphery of the label drum 13 by mechanic and pneumatic means until they are transferred to the pack 11.

In the embodiment of FIGS. 1 to 5, the labels 10 are extracted from a magazine 14 one after the other. Said magazine 14 is arranged above the label drum 13, slightly offset thereto in an upright position. The longitudinal extension (longitudinal axis) of the magazine 14 forms an acute angle with the vertical line, i.e. the magazine is arranged in a slightly inclined position.

At the bottom end, the magazine forms an extraction opening 15, which in this case nearly corresponds to the inner cross-section of the magazine 14. Below the extraction opening 15, a blank extraction means is movably arranged, namely a transfer roller 16 of known construction.

The blanks or labels 10 are introduced into the magazine 14 at the top end thereof - opposite the extraction opening 15. The labels 10 are successively severed (cut) from a web of material 17 whose width corresponds to the width of the rectangular labels 10. The web of material 17 is continuously drawn off a voluminous reel 18 which is mounted in the transport plane of the web of material 17 or labels 10. In relation to the packaging machine, which is not shown in detail, the reel 18 extends in a plane approximately parallel to the longitudinal mid-plane of the packaging machine, with the axis of rotation transverse thereto. Thus, the reel is arranged in a particularly space-saving manner.

The web of material 17 is drawn off the reel 18 and runs in several loops over a compensating looper 19 whose structure and funtion is already known in the art. Thereafter, the web of material 17 reaches a severing and feeding unit 20. Here, the individual labels 10 are produced as a result of appropriate portions being severed from the web of material 17.

Figure 2:
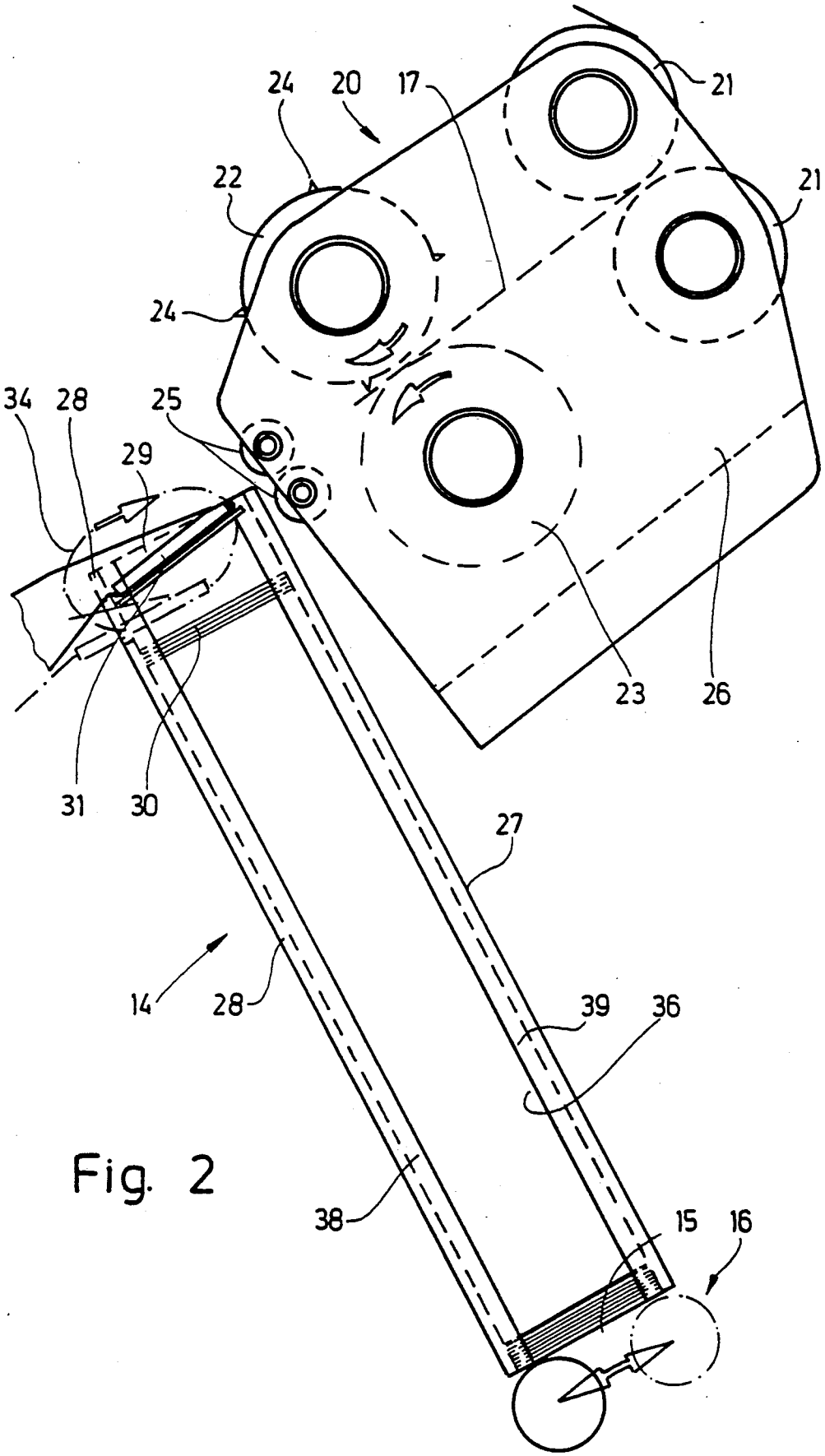
FIG. 2 shows a detail of the apparatus according to FIG. 1 on an enlarged scale.

In the embodiment according to FIGS. 1 and 2, the severing and feeding unit 20 consists of a pair of drawing rollers 21 for drawing the web of material 17 off the reel 18. The web of material 17 then arrives at a severing device which in this case consists of a knife roller 22 and a counter roller 23. The knife roller 22 is provided with a plurality of severing knives 24 distributed at equal distances over the periphery of the roller 22. Said severing knives 24 apply a severing cut every time they contact the web of material 17 fed through between the knife roller 22 and the counter roller 23. In the present embodiment, one revolution of the knife roller 22 severs four labels 10 from the web of material.

On leaving the severing and feeding unit 20, the labels 10 directly move into the adjacently arranged magazine 14, either running at the conveying speed of the web of material or at an increased speed. Such an increase in the conveying speed of the labels 10 after they have been severed is effected in the embodiment of FIGS. 1 and 2 by acceleration rollers 25, which are arranged on the severing and feeding unit 20, specifically at an appropriate distance to knife roller 22 and counter roller 23, such that the blank or label 10 is engaged immediately after being severed and is fed into the magazine 14 at increased speed.

The aforedescribed rollers 21, 22, 23, 25 of the severing and feeding unit are arranged on one or preferably two spaced supporting side plates 26 being connected to one another at the bottom end, so that the severing and feeding unit 20 forms an easy-to-handle unit.

The top part of the magazine 14 is designed in a special way. As is evident from FIG. 5, the magazine 14 expediently has a C-shaped cross-sectional profile. The rectangular labels 10 are fed into the magazine 14 with their (imaginary) longitudinal axis pointing in the conveying direction, i.e. they are fed into the magazine 14 via a narrow side thereof. The conveying plane of the labels, which is predefined by the severing and feeding unit 20, can be directed at an acute angle to the upper open side of the magazine 14, such that the labels 10 are "shot" into the upwardly open magazine 14 in a slightly downwardly directed conveying plane. The magazine 14 is designed and arranged such that the blanks or labels 10 hit against a stop on the side located opposite the inlet side (side wall 27), said stop being in this case formed by the opposite side wall 28. This side wall 28 may expediently be provided with an elevation extending beyond the dimension defined by the side wall 27 in order to ensure a sufficient stop for the incoming blanks. In the embodiment according to FIGS. 1 and 2, the labels 10 are thus introduced into the magazine via an upper inlet opening 29, specifically by way of being laterally fed towards the magazine, transverse to its axis.

Figure 3:
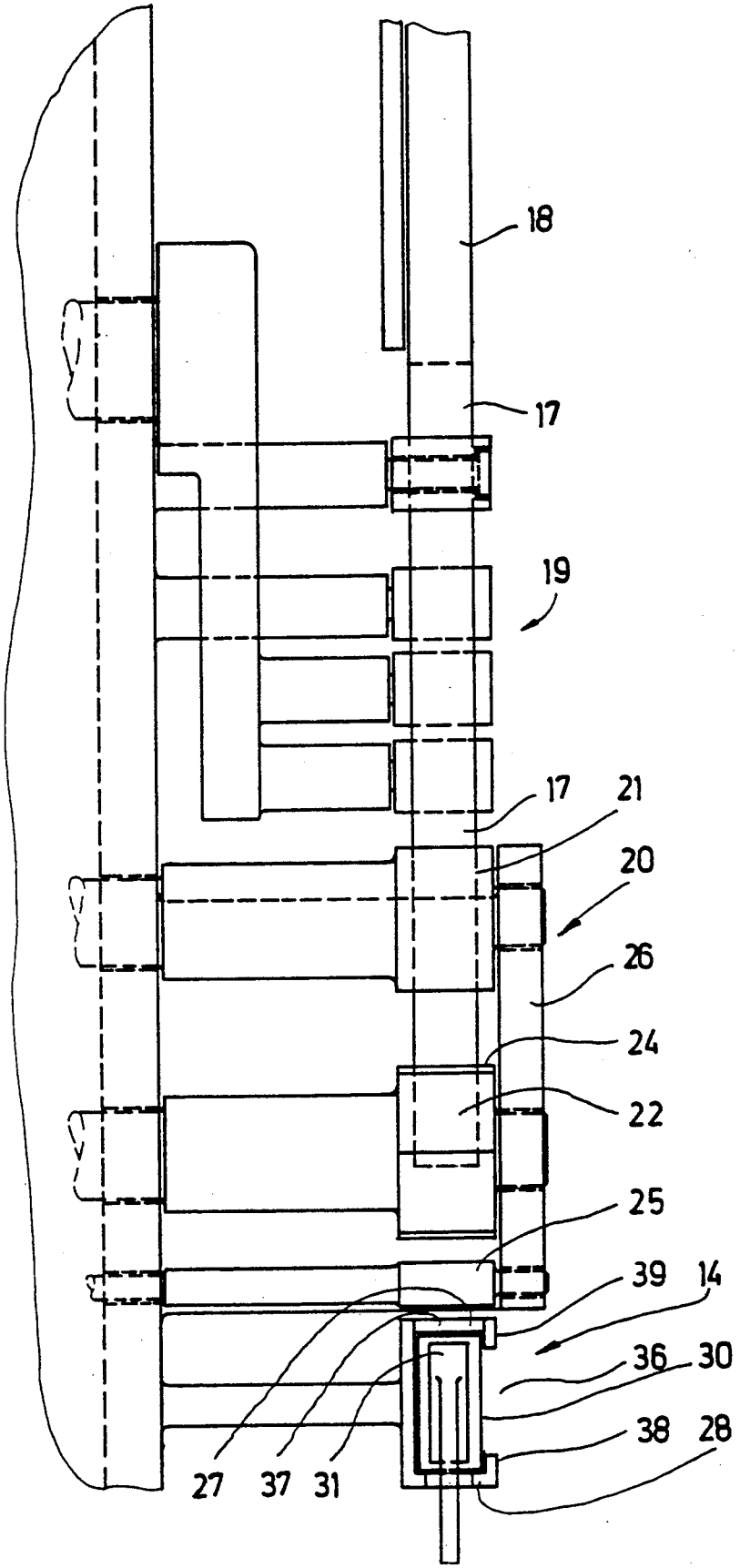
FIG. 3 is a plan view of part of the apparatus according to FIG. 1.
Figure 4:
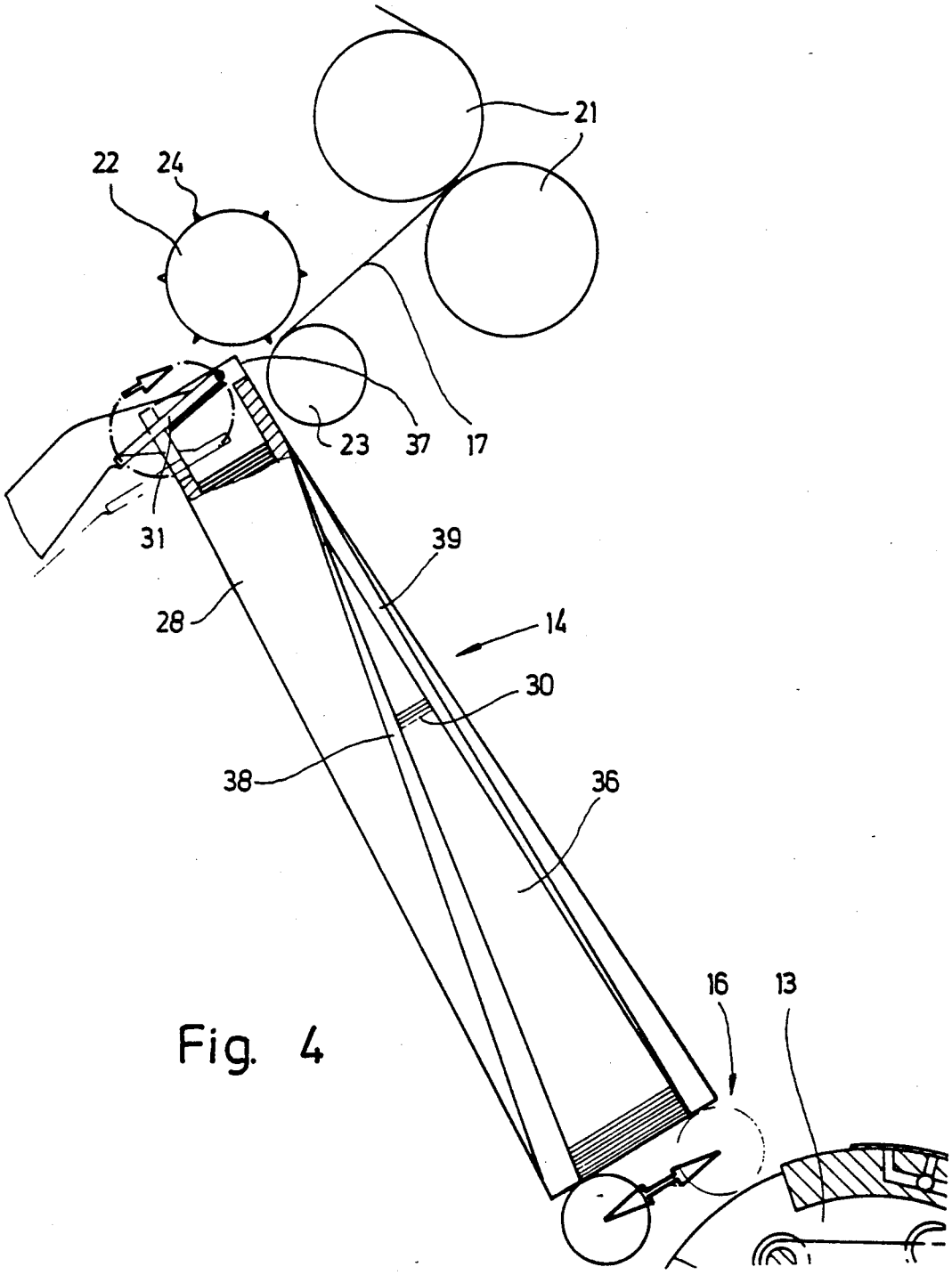
FIG. 4 shows a representation in analogy to FIG. 2 of another embodiment of the invention.
Figure 5:
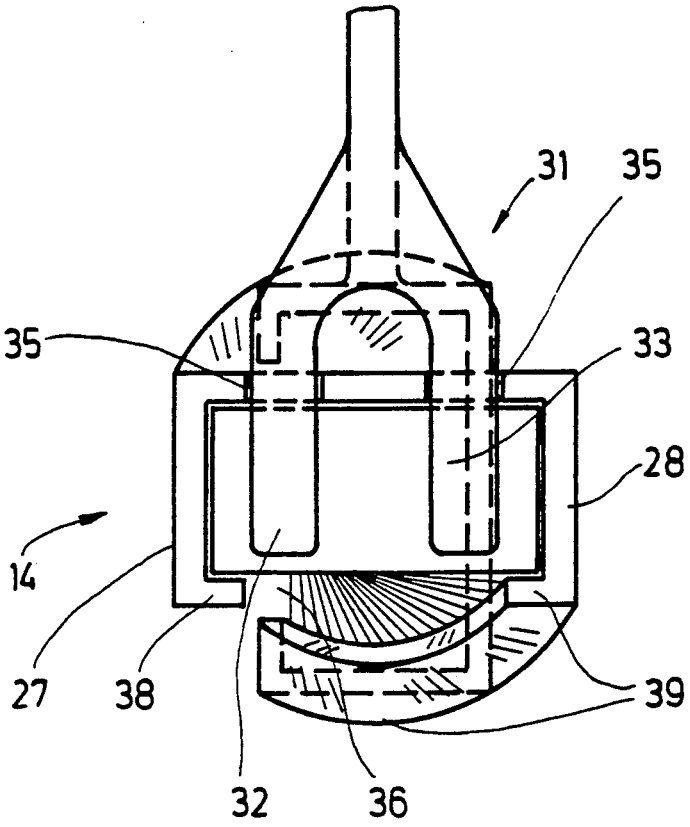
FIG. 5 is a top plan view of a magazine chute according to FIG. 4 on an enlarged scale.

In the magazine 14, the incoming labels 10 are deposited on a stack 30 formed within the magazine 14. To ensure that the labels 10 are safely deposited in their proper position, a lowering means for the labels 10 is arranged in this upper region of the magazine 14, namely a raisable and lowerable holding-down device 31. In the embodiment of FIG. 3, this holding-down device 31 consists of a simple plate which in the upper region of the magazine 14 enters the magazine 14 via a slot-shaped orifice in the side wall 28. In the embodiment of FIGS. 4 and 5, which will be described in more detail further below, the holding-down device 31 consists of two fingers 32, 33 which outside of the magazine 14 are connected to one another to form a forked unit. The holding-down device 31 engages the incoming labels 10 at their top side and downwardly conveys them in the magazine 14. The holding-down device 31 is movable in a special way, namely along an oval path of motion 34.

The holding-down device 31 with the forked design according to FIGS. 4 and 5 enters the magazine 14 with fingers 32, 33 via upwardly open slots 35 in the region of a (wider) rear wall. After a label 10 has been deposited, the fingers 32, 33 are withdrawn from the magazine 14, so that the next label 10 can be introduced into the magazine 14 without any delay. Outside the magazine, the holding-down device 31 is moved back to an upper position and is reintroduced into the magazine 14 from above. The label 10, which has been introduced into the magazine 14 during this returning movement of the holding-down device 31, is now moved down onto the stack 30 by the subsequent downward movement of the holding-down device 31.

As a result of its C-shaped profile, the magazine 14 is open at a longer side by being provided with a side opening 36 extending across the full height. Said side opening 36 is located in the region of a longer side dimension of the magazine. The width of the side opening 36 has been chosen large enough to allow a tool or hand to pass through, particularly for rectifying possible faults in the stacking of the labels 10.

The embodiment of FIG. 4 comprises a more simplified feed of the web of material 17 via the drawing rollers 21 and the knife roller 22 with counter roller 23. The latter two rollers are mounted immediately adjacent, i.e. at a small distance, to the upper end portion of the magazine 14. The severed labels 10 are fed into the magazine 14 directly by a knife roller 22 and counter roller 23. In this embodiment, the knife roller 22 is provided with a larger number of severing knives 24, so that a respectively larger number of labels 10 is produced with each revolution.

In the entrance area of the labels 10, the magazine 14 is designed such that an inlet opening 37 is formed in the region of a lateral limitation (side wall) of the magazine 14. Said lateral limitation is recessed relative to an upper edge and particularly in relation to an opposite side wall 28, so that a free and upwardly open inlet opening 37 for the lateral introduction of labels 10 into the magazine 14 is formed.

In the embodiment of FIG. 4, this inlet opening 37 is formed in the region of a wider transverse dimension of the magazine. The rectangular oblong labels 10 are thus severed from the correspondingly wide web of material 17 in such a way that they are directed with their longitudinal extension transverse to the conveying direction. This means that the labels 10 are severed from the web of material 17 breadthways and are inserted via the broad side into the magazine 14 in a corresponding relative position, in this case at the side of side opening 36.

Because the labels 17 have to be extracted in the longitudinal direction thereof at the bottom side of the magazine 14, this embodiment provides for a turning movement of the labels 10 while they are moving downward within the magazine 14. Consequently, the labels 10 are extracted from the magazine by means of the transfer roller 16 in a position which is offset by 90° relative to the upper introducing position.

For this purpose, the magazine 14 is designed such that the side walls 27, 28 and side panels 38, 39 for limiting the side orifice 36 are helically twisted, such that in the upper region, especially at the inlet opening 37, the larger dimension of the magazine (side orifice 36) is facing towards the arriving labels 10, while the same side of the magazine is turned by 90° in the bottom region as a result of the twisted form. Since the stacked labels 10 are guided in their gradual downward movement within the magazine by the side walls 27, 28 and the panels 38, 39, a respective turning movement of the labels 10 in their plane is automatically effected.

It is not necessary to change over the reels etc. for a different type (model) of label. For a merely temporary change of labels, the magazine 14 can instead be manually filled by introducing stacks of labels into the upwardly open magazine 14, without any refitting work.

Figure 6:
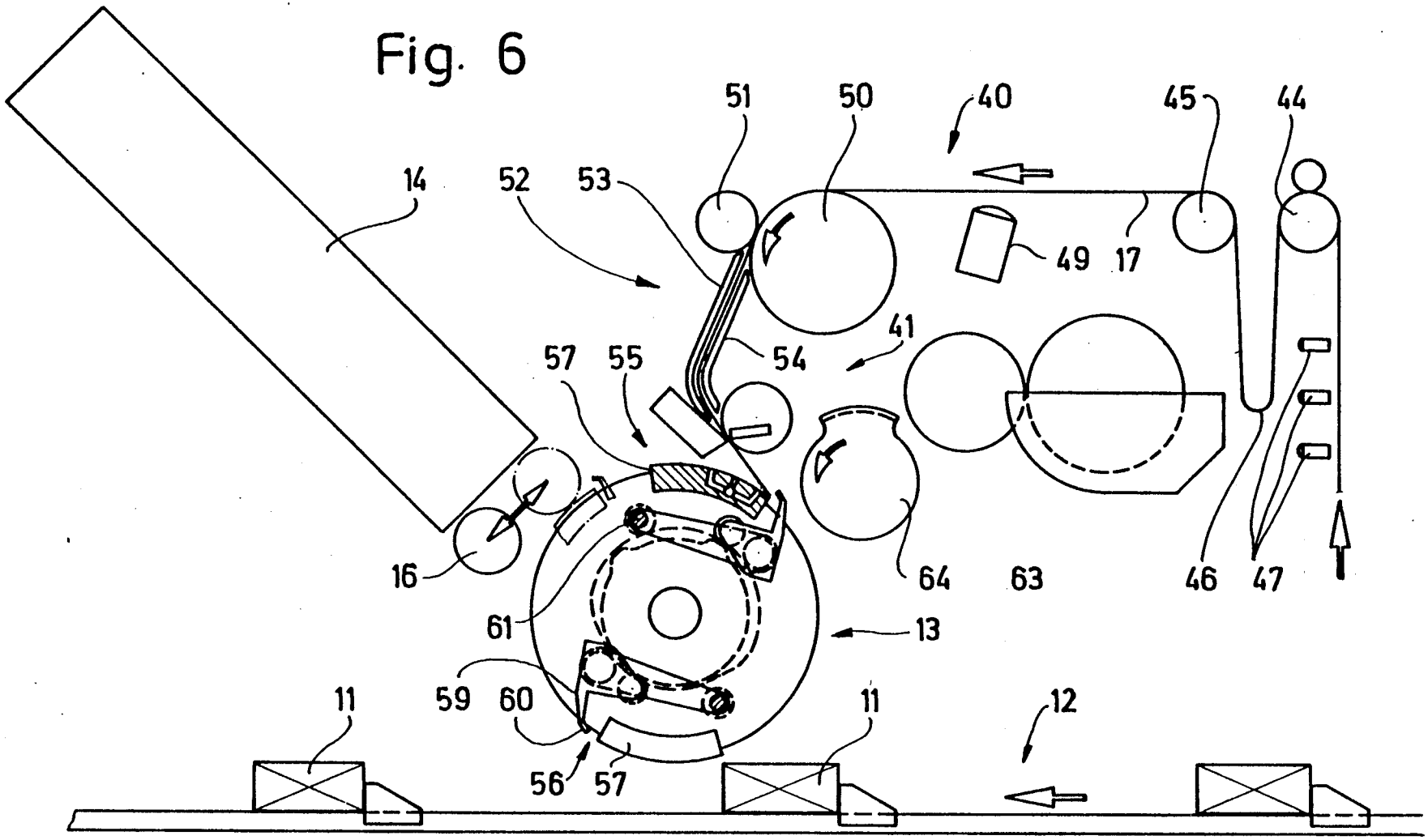
FIG. 6 is a schematic side view in analogy to FIG. 1 of another embodiment of an apparatus.
Figure 7:
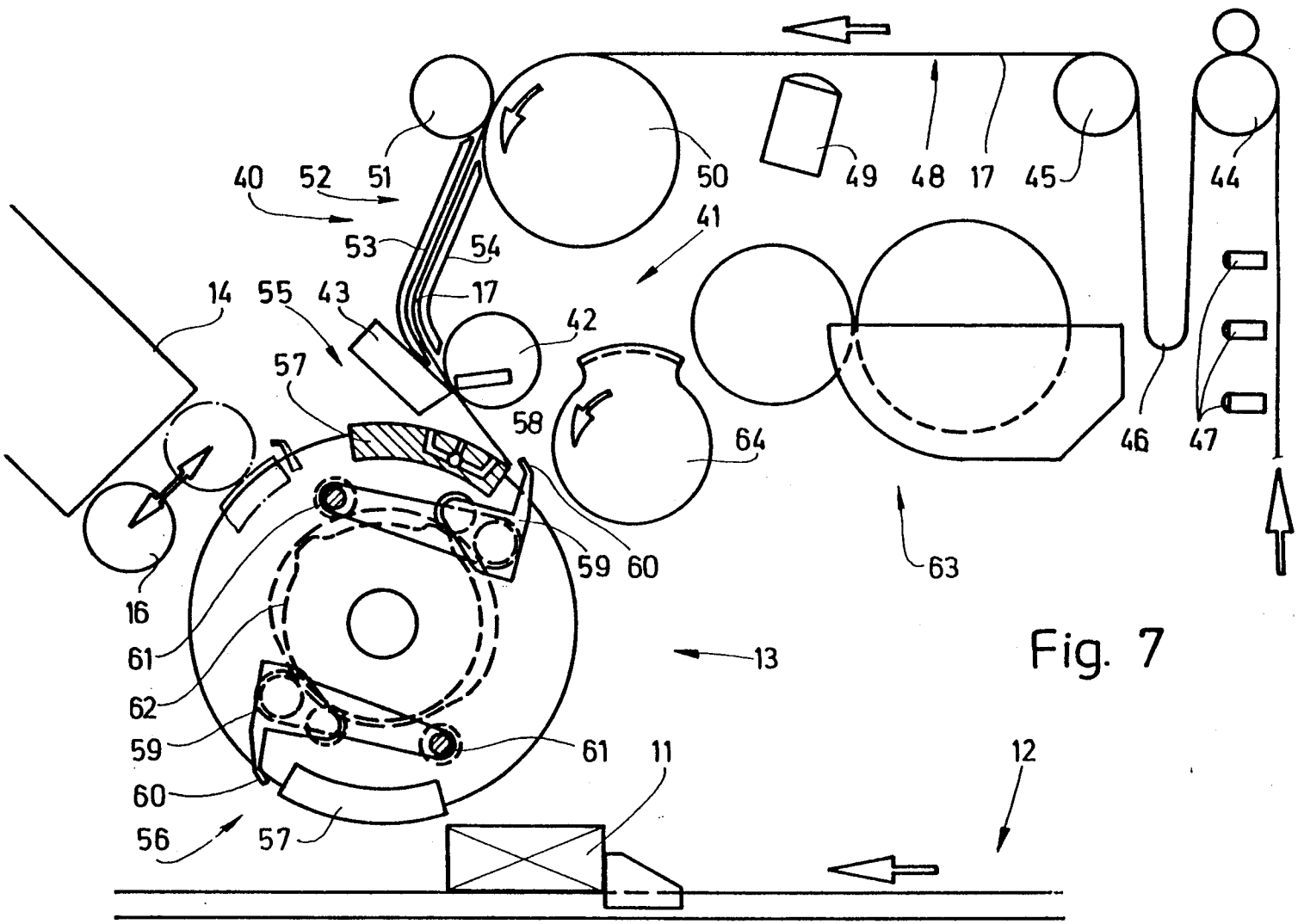
FIG. 7 shows a detail of the apparatus according to FIG. 6 on an enlarged scale.

In the embodiment according to FIGS. 6 and 7, the production and feed of the labels 10 is conducted by severing the labels 10 from the web of material 17 independently of the (conventionally designed) magazine 14. Into this magazine, labels 10 produced elsewhere can be inserted in stacks.

In this embodiment, the production and feeding of the blanks or labels 10 by severing the labels 10 from the web of material 17 is conducted by a separate label unit 40. This unit 40 comprises a cutting unit 41 for severing the individual labels 10 from the web of material 17. The cutting unit 41 is arranged directly adjacent to the label drum 13, such that the severed labels 10 are directly received and conveyed further by the label drum 13. The cutting unit consists of a rotating knife roller 42 and a stationary counter knife 43.

The web of material coming from a reel (not shown) forms a loop of material 46 (sag) between deflecting rollers 44, 45, said loop acting as a variable web reservoir. The size of the loop of material 46 is monitored, in the present case by means of optoelectric sensors 47 which control the drive of the deflecting roller 44 and therewith the feed of the web of material 17.

The deflecting roller 45 is followed by a horizontal conveying portion 48 of the web of material 17. Within this portion 48, the web of material, in particular exactly positioned control markings thereof, is scanned. For this purpose, a known optoelectric scanning means 49 is provided.

At the end of the horizontal conveying portion 48, the web of material 17 runs over feed rollers 50, 51. These are driven very precisely, such that the portion of the web of material 17 following in the conveying direction is subjected to a very accurate feed. The feed rollers 50, 51 are preferably driven by a stepping motor (not shown) whose movements are controlled by the scanning means 49 and therewith in response to the control markings on the web of material 17.

Downstream of the feed rollers 50, 51, the web of material 17 is fed towards the cutting unit 41 along a conveying portion which is essentially downwardly directed. In the area between the feed rollers 50, 51 and the cutting unit 41, the web of material 17 is exactly guided, specifically by means of a rigid track guide 52. Said track guide 52 consists of two guide walls 53, 54 arranged at a small distance on both sides of the web of material 17.

In the lower region, the track guide 52 changes direction in a curved manner, such that a portion of the web of material facing towards the label drum 13 and the cutting unit 41 is directed at an acute angle relative to the periphery of the label drum 13.

In the present embodiment, the label drum 13 is provided with two label holders 55, 56 located diagonally opposite one another. These holders 55. 56 each consist of a contact member 57 for the label, projecting from the peripheral surface of the label drum 13 in the radial direction. An outer contact surface of this contact member 57 is curved, concentrically relative to the label drum 13. In a forward region with respect to the conveying direction, suction bores 58 open out into the contact surface of the contact member 57, said suction bores being connected to a central vacuum source by means of suction channels. Suction air is applied to the suction bores 58 when a label 10 is taken over and during transport thereof.

Furthermore, the label holder 55, 56 is associated with a mechanical holding means for engaging and holding an end portion of the label 10 which is forwardly located relative to the conveying direction. In the present embodiment, this holding means is in the form of a clamping finger 59 having a slightly bent clamping end 60. In clamping position, this clamping end 60 rests against the forward region of the contact member 57, relative to the direction of rotation of the label drum 13, and thus clamps the front end of the label 10. The clamping finger 59 is designed as a bent two-armed lever, which is pivotally movable to an opening position (as shown in FIGS. 6 and 7) and a clamping position. For this purpose, a free end of the clamping finger 59 runs on an appropriately formed cam disc 62 with a tracer roller 61. The opening and clamping positions are determined by the form of the cam disc 62.

The cutting unit 41 is arranged immediately adjacent to the periphery of the label drum 13, specifically such that the web of material 17 moves onto the label holder 55, 56 before the label 10 is severed. Before the severing cut is applied, the front end of the web of material 17 is already fixed on the label holder 55, 56, specifically by means of the clamping finger 59 moving in clamping position. At the time the severing cut is applied immediately thereafter, the label 10 is already held on the label drum 13.

A gluing unit 63 is arranged such, that a glue segment 64 transfers glue strips onto the outwardly directed face of the label 10 when the latter rests on the label holder 55, 56, directly downstream of the cutting unit 41.

What is claimed is:

1. A process for conveying blanks to be transferred to packs, said blanks being successively severed from a continuous web of material and being conveyed into a position ready for being received by the packs, characterized in that:

the blanks (10), after being severed from the web of material (17), are individually conveyed in succession into a chute-like magazine and are extracted therefrom for being transferred to the packs (11); and the blanks (10), severed from the web of material (17) and fed into the magazine (14) transverse to their longitudinal extensions, are turned during a downward movement in the magazine (14), such that each blank (10) is extractable at a bottom side of the magazine (14) with its longitudinal extension pointing in the conveying direction.

2. The process as claimed in claim 1, wherein said blanks (10), immediately after being severed from the web of material (17), are individually feedable into the magazine (14) and depositable on a blank stack (30) therein by means of being conveyed in a direction essentially horizontal or downwardly inclined at a very acute angle and transverse to a longitudinal extension of said magazine (14).

3. The process as claimed in claims 1 or 2, wherein the blanks (10), after being severed from the web of material (17), are accelerated in the conveying direction and are laterally fed into the magazine (14) at increased speed.

4. An apparatus for conveying labels to packs in the region of a packaging machine, said labels being successively severed from a web of material and being transportable by a label conveyor (13) to a position ready for being received by the successively supplied packs (11), characterized in that:

the labels (10), after being severed from the web of material (17), are directly feedable into a magazine (14) and are stackable therein, the labels (10) being fed into said magazine (14) at a top side thereof and being individually extractable at a bottom side thereof; and rectangular labels (10) are severable from the web of material (17) in a position in which the longitudinal extension of said labels (10) is transverse to said web of material (17); and the labels (10) are feedable into the magazine (14) in this transverse position, each label (10) being turnable by 90° C. during downward movement within said magazine (14) and being extractable from the magazine (14) with its longitudinal extension pointing in the conveying direction.

5. The apparatus as claimed in claim 4, wherein the limitations of the magazine (14), are twisted in a screwthread-like manner, such that in the case of a rectangular cross-section of the magazine (14), the longitudinal extension in the upper region is directed transverse to the feed direction of the labels (10) and in the lower region is directed in the conveying direction of the labels (10).

6. The apparatus as claimed in claim 4, wherein a cutting unit (41), for severing labels from the web of material, is arranged at an exit side of a stationary track guide (52) for the web of material (17), said track guide (52) comprising guide walls (53, 54) arranged at a small distance from one another.

7. The apparatus as claimed in claim 6, wherein the web of material (17) is feedable to the cutting unit (41) by means of feed rollers (50, 51) driven by a stepping motor, said stepping motor being controllable in response to exact markings of the web of material (17).

8. The apparatus as claimed in claim 7, wherein the track guide (52) follows the feed rollers (50, 51) in downward direction and extends in a curved change of direction towards the cutting unit (41), such that the web of material (17) or the severed label (10) are directed at an acute angle relative to a peripheral surface of the label conveyor (13).

9. The apparatus as claimed in claim 8, wherein an end portion of the web of material (17) projecting from the track guide (52) is directed in the direction of a label holder (55, 56).

10. The apparatus as claimed in claim 4, wherein the same label conveyor (13) is associated with a stationary magazine (14) for holding a stack of labels (10) and for passing these labels to the label conveyor (13), and for providing an alternative feed of the label conveyor (13) with labels (10) upstream of the cutting unit (41) relative to the conveying direction.

* * * * *